US006149444A

United States Patent [19]

Shi et al.

[11] Patent Number: 6,149,444

[45] Date of Patent: Nov. 21, 2000

[54] ELECTRICAL CONNECTOR WITH GROUNDING MEANS

[75] Inventors: Guang-Xing Shi; Liang Gong; Xin-Hai Xiang, all of Kun-San, China

[73] Assignee: Hon Hai Precision Ind. Co., Ltd., Taipei Hsien, Taiwan

[21] Appl. No.: 09/373,030

[22] Filed: Aug. 11, 1999

[30] Foreign Application Priority Data

Feb. 2, 1999 [TW] Taiwan ..... 88201720

[51] Int. Cl.[7] ..... H01K 13/648

[52] U.S. Cl. ..... 439/95; 439/939

[58] Field of Search ..... 439/92, 95, 939, 439/607, 609

[56] References Cited

U.S. PATENT DOCUMENTS

| | | | |
|---|---|---|---|
| 4,906,201 | 3/1990 | Young et al. | 439/939 |
| 5,266,053 | 11/1993 | Jamet et al. | 439/939 |
| 5,622,523 | 4/1997 | Kan et al. | 439/939 |
| 5,772,471 | 6/1998 | Buck | 439/939 |
| 5,913,698 | 6/1999 | Keng | 439/939 |

*Primary Examiner*—Gary F. Paumen
*Attorney, Agent, or Firm*—Wei Te Chung

[57] ABSTRACT

An electrical connector comprises an insulative housing, a shell, a number of terminals received in the housing and grounding means attached to the shell and engaging means. The housing comprises a mating surface with a number of terminal receiving passageways defined therein and an adjacent mounting surface perpendicular to the mating surface. One end of each terminal is received in the corresponding passageway of the housing and the other end is bent to extend through the mounting surface for connecting with a circuit board. The grounding means attached to the shell comprises at least a resilient spring finger appropriately bent and warped relative to the mating surface. After the circuit board is assembled within a computer with the connector mounted thereon extending through a corresponding slot formed in a computer panel, the spring finger of the grounding means reliably contacts an inner surface of the computer panel to establish a grounding path thereby eliminating interference caused by static electricity and ensuring stable signal transmission between the connector and a mating connector.

2 Claims, 5 Drawing Sheets

ELECTRICAL CONNECTOR WITH GROUNDING MEANS

BACKGROUND OF THE INVENTION

The present invention relates to an electrical connector, and more particularly to an electrical connector having grounding means for eliminating interference caused by static electricity thereby ensuring reliable signal transmission between the connector and a mating connector.

DESCRIPTION OF PROIR ART

A right angled, D-shaped electrical connector is commonly used as an input/output (I/O) device to interconnect external peripheral equipment to a computer. The connector is mounted to a circuit board located within a housing of the computer with a mating portion thereof outwardly extending through a slot formed in a rear panel of the housing to mate with a complementary connector. To eliminate static electricity accumulated on a shell of the connector, a grounding path should be formed between the shell and an inner surface of the computer panel. The contact between the shell and the rear panel depends on the mounting location of the circuit board and the connector relative to the panel.

However, since a gap inevitably exists between the circuit board and the panel, the electrical connector mounted on the circuit board is offset from the slot of the computer panel whereby the shell of the connector fails to properly contact the inner surface of the computer panel. Hence, an electrical connector having improved grounding means for ensuring stable signal transmission is requisite.

SUMMARY OF THE INVENTION

Accordingly, an object of the present invention is to provide an electrical connector having grounding means reliably abutting against an inner surface of a computer panel for eliminating interference caused by static electricity thereby ensuring stable signal transmission between the connector and a mating connector.

Another object of the present invention is to provide grounding means suitable for various electronic devices for establishing a grounding path between the device and a related electronic system thereby eliminating static electricity and ensuring stable signal transmission therebetween.

In order to achieve the objects set forth, an electrical connector in accordance with the present invention comprises an insulative housing, a shell, a plurality of terminals received in the housing, grounding means attached to the shell and engaging means. The housing comprises a mating surface with a plurality of terminal-receiving passageways defined therein and an adjacent mounting surface perpendicular to the mating surface. One end of each terminal is received in the corresponding passageway of the housing and the other end is bent to extend through the mounting surface for connecting with a circuit board. The grounding means attached to the shell comprises at least a resilient spring finger appropriately bent and warped relative to the mating surface. After the circuit board is assembled within a computer with the connector mounted thereon extending through a corresponding slot formed in a computer panel, the spring finger of the grounding means reliably contacts an inner surface of the computer panel to establish a grounding path thereby eliminating interference caused by static electricity and ensuring stable signal transmission between the connector and a mating connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
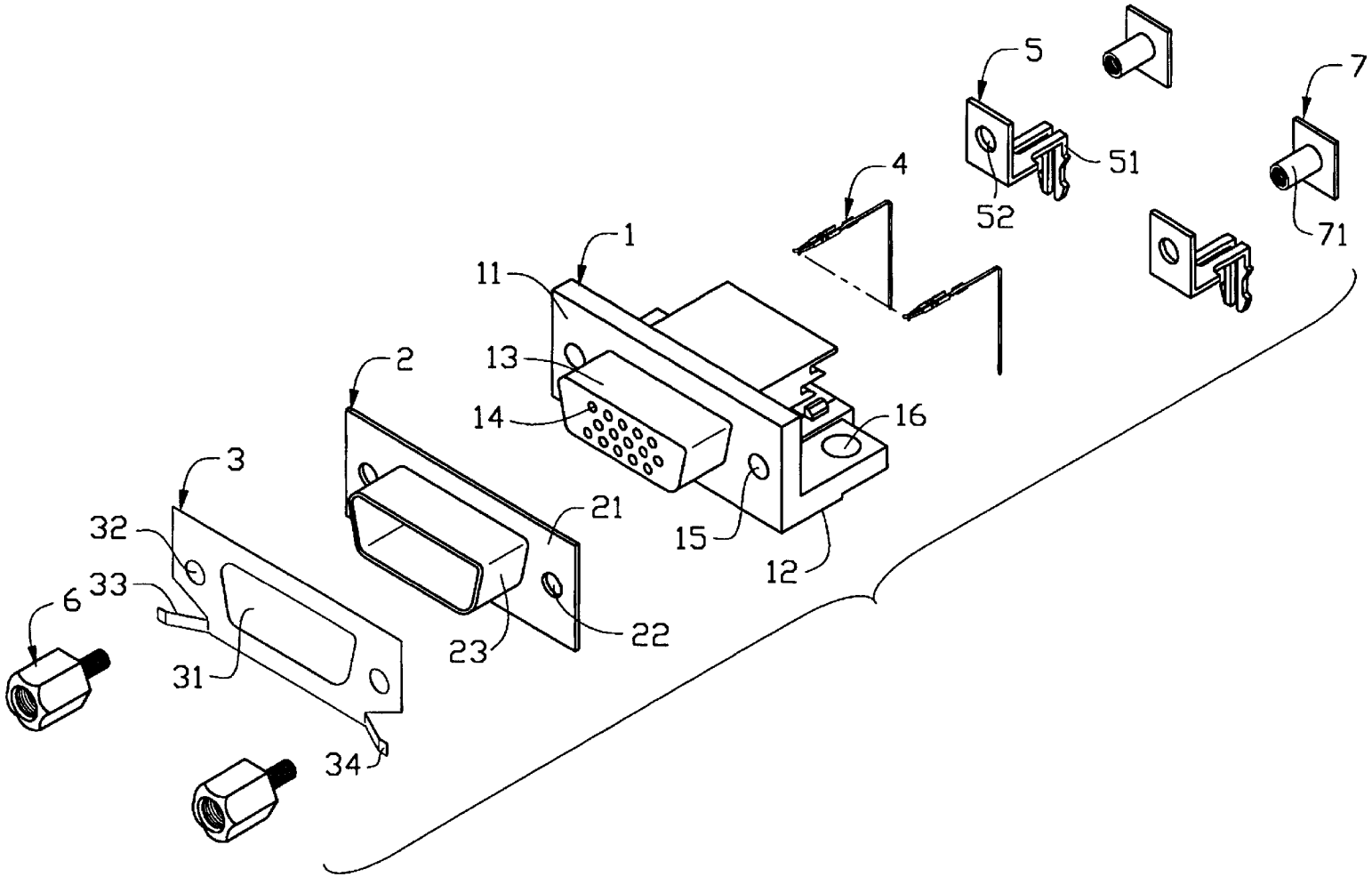
FIG. 1 is an exploded view of an electrical connector in accordance with a first embodiment of the present invention.

For facilitating understanding, like components are designated by like reference numerals throughout the various embodiments of the invention as shown in the attached drawings.

Referring to FIG. 1, an electrical connector in accordance with a first embodiment of the present invention comprises an insulative housing 1, a shell 2, a grounding sheet 3, a plurality of terminals 4 and engaging means which includes a pair of board locks 5, screw locks 6 and clinch nuts 7. The housing 1, formed from a dielectric material such as plastic, comprises a mating surface 11 and a mounting surface 12 perpendicular to the mating surface 11. A mating portion 13 extends from the mating surface 11 with a plurality of terminal receiving passageways 14 defined therein through the housing 1. A pair of spaced through holes 15 is disposed in opposite ends of the mating surface 11 for the extension of cylindrical sections 71 of the clinch nuts 7 therethrough. A pair of mounting holes 16 is disposed in opposite ends of the mounting surface 12 for the extension of mounting legs 51 of the board locks 5 therethrough to lock into corresponding holes of a circuit board 9 (FIG. 4) thereby mounting the connector thereon.

One end of each terminal 4 is received in the passageway 14 of the housing 1 and extends toward the mating portion 13 for connecting with a corresponding terminal of a mating connector (not shown). The other end of the terminal 4 is bent perpendicularly to extend through the mounting surface 12 for being subsequently inserted into a corresponding receiving hole (not shown) of the circuit board.

The shell 2 is stamped and formed from sheet metal for shielding the housing 1 from electromagnetic and radio frequency interference (EMI/RFI). The shell 2 comprises a flange 21 with a pair of holes 22 disposed in opposite ends thereof in alignment with the through holes 15 of the housing 1. A D-shaped shroud 23 corresponding to the mating portion 13 of the housing 1 projects from the flange 21 for enclosing the mating portion 13.

The grounding sheet 3 stamped and formed from resilient sheet metal comprises a D-shaped opening 31 corresponding to the mating portion 13 of the housing 1 and the shroud 23 of the shell 2. A pair of apertures 32 is disposed in opposite ends of the sheet 3 in alignment with the through holes 15 of the housing 1 and the holes 22 of the shell 2 for the extension of the cylindrical sections 71 of the clinch nuts 7 therethrough. A pair of integrally stamped and bent spring fingers 33 outwardly extends from opposite ends of a bottom edge of the grounding sheet 3 adjacent to the apertures 32. Each spring finger 33 comprises a planar section 34 on a free end thereof for a reliable contact with an inner surface of a panel of a computer housing thereby establishing a grounding path.

Figure 2:
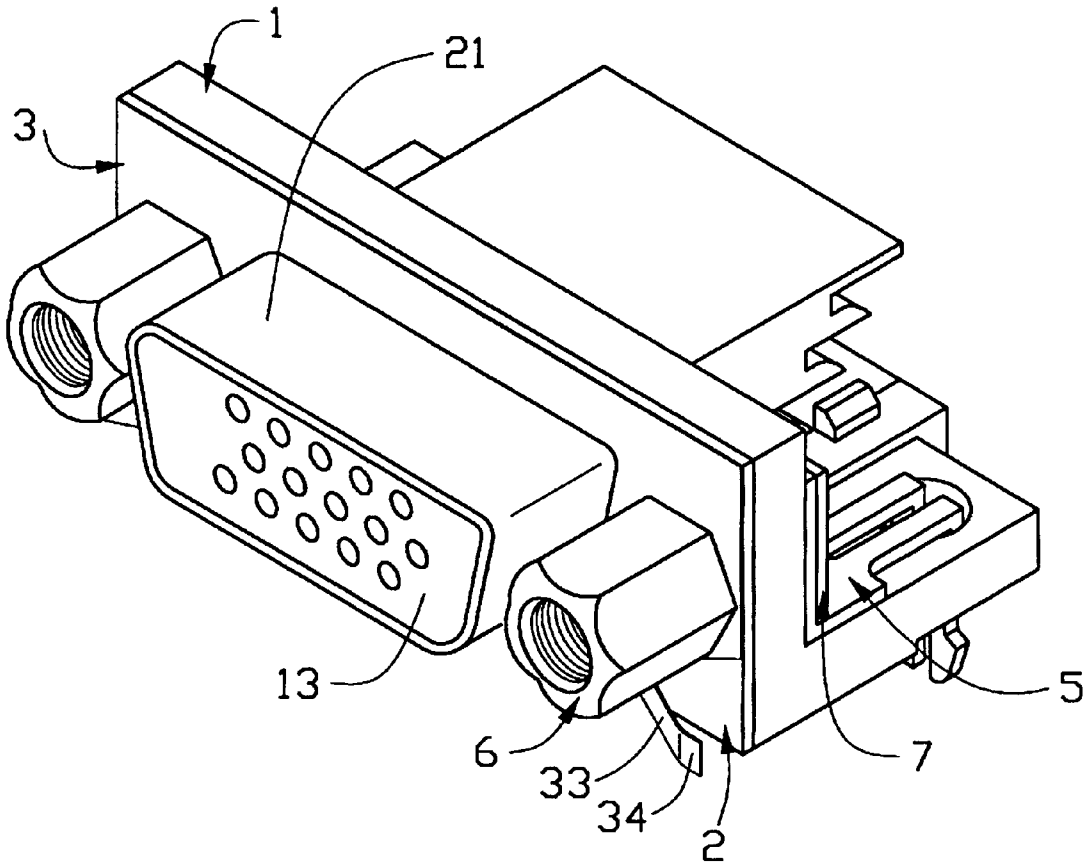
FIG. 2 is an assembled view of FIG. 1.

Also referring to FIG. 2, in assembly, the legs 51 of the board locks 5 are inserted through the mounting holes 16 with locking apertures 52 of the board locks 5 aligning with the through holes 15 of the housing 1. The clinch nuts 7 are sequentially extended through the locking apertures 52 of the board locks 5, the through holes 15 of the housing 1, the holes 22 of the shell 2 and the apertures 32 of the grounding sheet 3 for engaging with the screw locks 6 thereby securing the shell 2 and the grounding sheet 3 to the mating surface 11 of the housing 1. After assembly, the shroud 23 of the shell 2 encloses the mating portion 13 of the housing 1 and the grounding sheet 3 abuts against the flange 21 of the shell 2, and the shroud 23 projects through the opening 31 of the grounding sheet 3.

Figure 4:
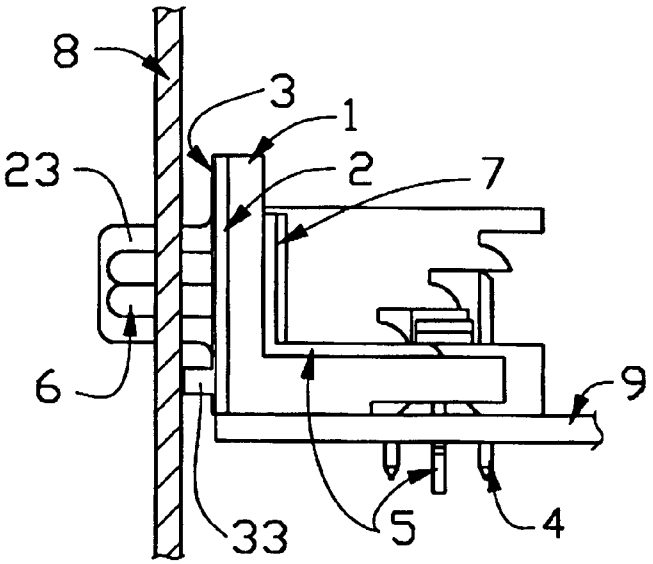
FIG. 4 is a side plan view of the electrical connector of FIG. 2 engaged with a rear panel of a computer housing.
Figure 3:
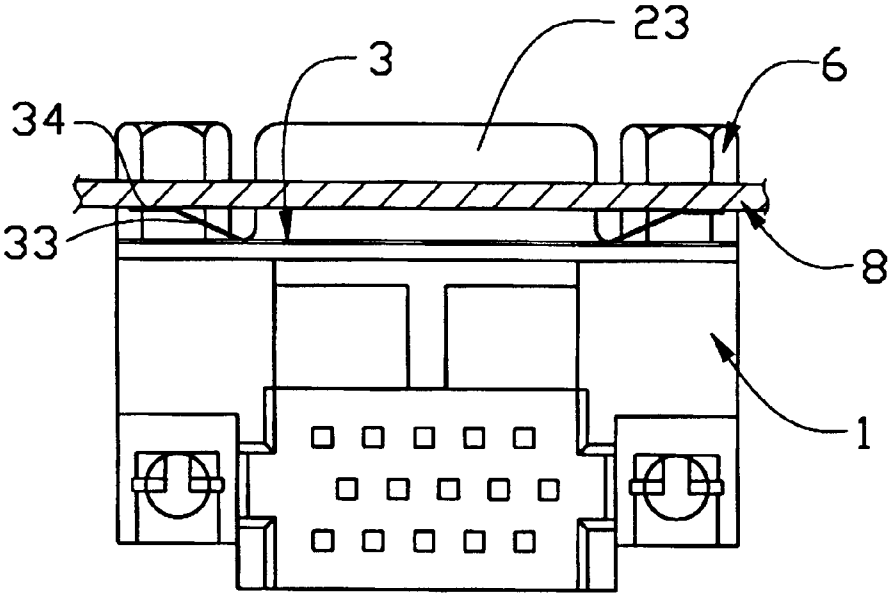
FIG. 3 is a bottom plan view of the electrical connector of FIG. 2 engaged with a rear panel of a computer housing.

Referring to FIGS. 3 and 4, after the circuit board 9 to which the connector is mounted is assembled within a computer housing (not shown), the mating portion 13 of the connector extends through a corresponding slot (not labeled) disposed in a computer panel 8 for connecting with the mating connector. The distance that the mating portion 13 of the connector extends beyond the computer panel 8 varies due to a gap (not labeled) being defined between the circuit board 9 and the panel 8. Since the grounding sheet 3 is stamped and formed from resilient sheet metal, the spring fingers 33 compensate for the variation in the size of the gap between the circuit board 9 and the panel 8 thereby ensuring reliable contact between the connector and the panel 8. The mounting legs 51 can also be soldered to ground traces on the circuit board 9 whereby interference caused by static electricity is eliminated and stable signal transmission is ensured.

Figure 5:
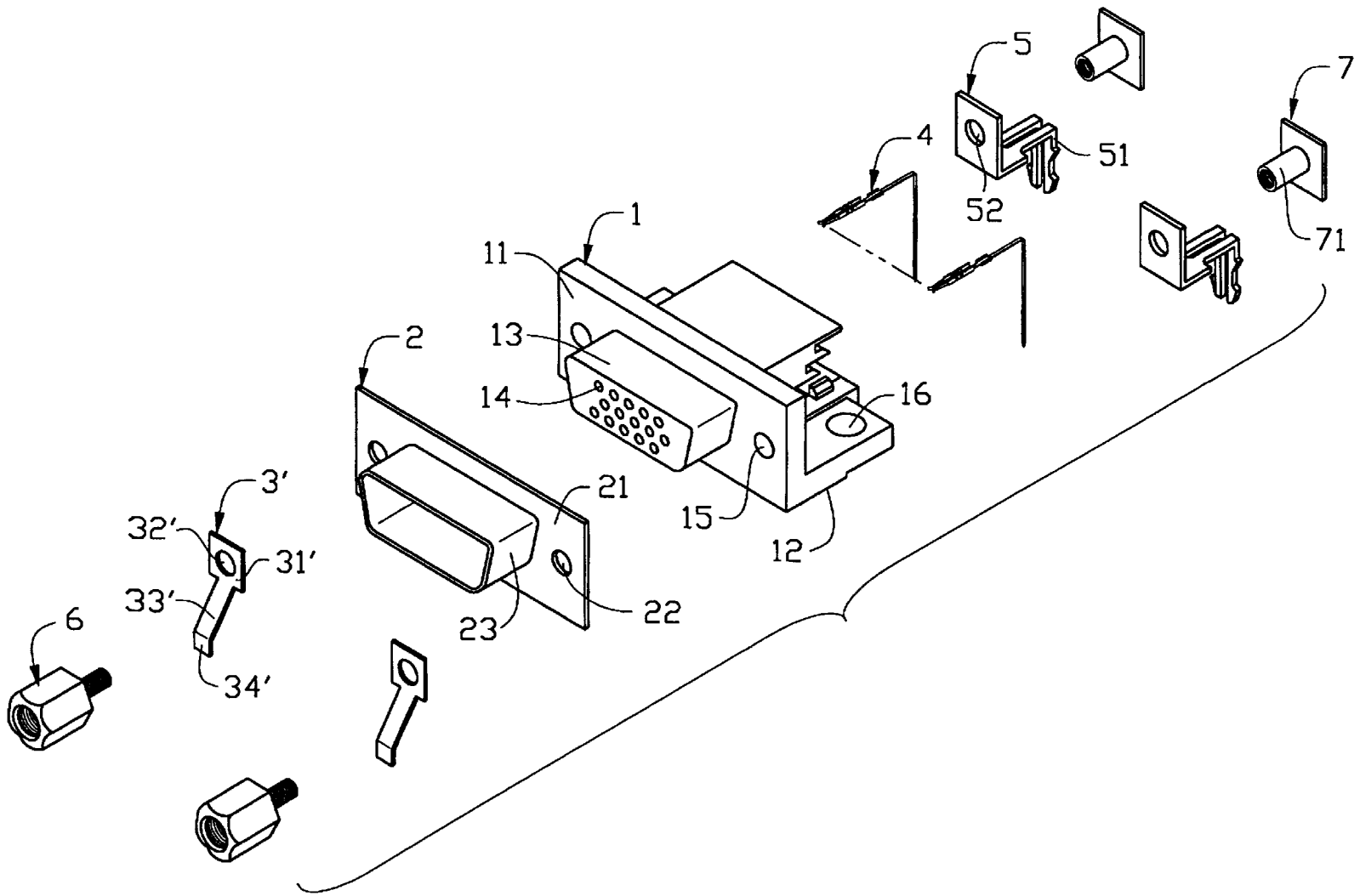
FIG. 5 is an exploded view of an electrical connector in accordance with a second embodiment of the present invention.

An exploded view of an electrical connector in accordance with a second embodiment of the present invention is illustrated in FIG. 5. A pair of grounding clips 3' is stamped and formed from resilient sheet metal. Each clip 3' comprises a planar portion 31' with an aperture 32' disposed therein for the extension of the screw lock 6 therethrough. A spring finger 33' extends from the planar portion 31' and is appropriately bent to define a planar section 34' on a free end thereof for a reliable contact with the inner surface of the computer panel. Since the other components of the second embodiment are similar to those of the first embodiment, a detailed description thereof is omitted herein.

Figure 6:
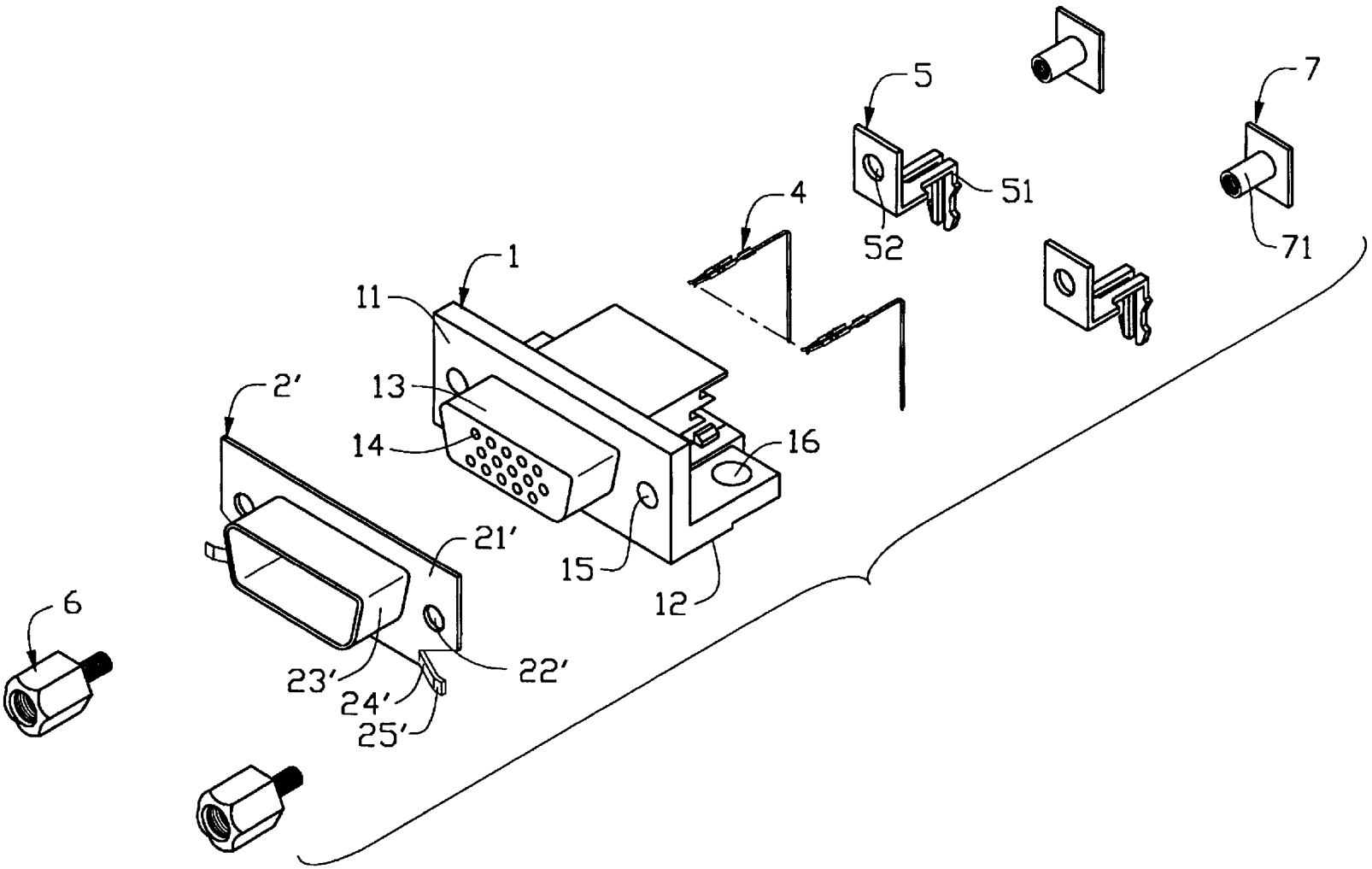
FIG. 6 is an exploded view of an electrical connector in accordance with a third embodiment of the present invention.

FIG. 6 shows an exploded view of an electrical connector in accordance with a third embodiment of the present invention. A pair of spring fingers 24' are integrally stamped and bent on opposite ends of a bottom edge of a shell 2' adjacent to a pair of holes 22' disposed in the shell 2'. A planar section 25' is formed on a free end of each spring finger 24'. Each spring finger 24' has a shape identical to that of the spring finger 33 of the first embodiment and serves the same function. Since the other components of the third embodiment are similar to those of the first embodiment, a detailed description thereof is omitted herein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector mounted to a circuit board for connecting a mating connector to the circuit board through a corresponding slot disposed in a computer panel, comprising:

an insulative housing comprising a mating surface, a mating portion projecting from the mating surface to extend through the slot of the computer panel, a plurality of terminal receiving passageways through the mating portion, and a mounting surface perpendicular to the mating surface;

a metal shell abutting against the mating surface of the housing, the metal shell having a shroud enclosing the mating portion of the housing;

a plurality of terminals each having one end received in corresponding passageway of the housing and having the other end bent perpendicularly to extend through the mounting surface of the housing for connecting to the circuit board; and grounding means in electrical connection with the metal shell and comprising at least one spring finger resiliently bent to contact an inner surface of the computer panel;

wherein the grounding means comprises a metal sheet having an opening for entrance of the shroud of the shell, and two spring fingers are integrally formed on two opposite ends of a bottom edge of the metal sheet;

wherein the metal sheet comprises a pair of apertures disposed in opposite ends thereof for extension of screw locks therethrough;

wherein the mating surface of the housing comprises a pair of through holes disposed in opposite ends thereof for extension of the screw locks therethrough thereby fastening the grounding means, the shell and the housing together.

2. An electrical connector mounted to a circuit board for connecting a mating connector to the circuit board through a corresponding slot disposed in a computer panel, comprising:

an insulative housing comprising a mating surface, a mating portion projecting from the mating surface to extend through the slot of the computer panel;

a plurality of terminals received within the housing;

a metal shell abutting against the mating surface of the housing, the metal shell having a shroud enclosing the mating portion of the housing; and grounding means mechanically and electrically connected to the metal shell and comprising at least one spring finger resiliently bent to contact an inner surface of the computer panel;

wherein said grounding means defines an opening surrounding the shroud of the shell;

wherein said grounding means is fastened to the shell by a screw lock, and wherein said screw lock cooperates with a clinch nut to fasten the shell, the housing, the grounding means, and a board lock together;

wherein said grounding means has two spring fingers integrally formed on two opposite ends of a bottom edge thereof.

* * * * *